US006523851B1

(12) United States Patent
Maravetz

(10) Patent No.: US 6,523,851 B1
(45) Date of Patent: Feb. 25, 2003

(54) BINDING MECHANISM FOR A TOURING SNOWBOARD

(75) Inventor: Paul T. Maravetz, Morrisville, VT (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 09/532,320

(22) Filed: Mar. 21, 2000

(51) Int. Cl.[7] ..... A63C 5/02
(52) U.S. Cl. ..... 280/603; 623/14.22; 623/14.26
(58) Field of Search ..... 280/14.21, 14.22, 280/14.24, 14.26, 603, 607, 608, 609, 623, 626, 629, 818

(56) References Cited

U.S. PATENT DOCUMENTS

| | | | | |
|---|---|---|---|---|
| 3,171,667 A | | 3/1965 | Wightman | |
| 3,439,928 A | * | 4/1969 | Noguchi | 280/603 |
| 3,506,279 A | | 4/1970 | Lambert | |
| 3,593,356 A | | 7/1971 | Schmalfedt | |
| 3,627,349 A | * | 12/1971 | Barry | 280/818 |
| 3,782,745 A | | 1/1974 | Stoveken | |
| 3,861,698 A | | 1/1975 | Greig | |
| 4,022,491 A | | 5/1977 | Powell | |
| 4,062,553 A | | 12/1977 | Riedel | |
| 4,138,128 A | | 2/1979 | Criss | |
| 4,163,565 A | | 8/1979 | Weber | |
| 4,221,394 A | | 9/1980 | Campbell | |
| 4,275,904 A | | 6/1981 | Pedersen | |
| 4,403,785 A | | 9/1983 | Hottel | |
| 4,652,007 A | | 3/1987 | Dennis | |
| 4,700,967 A | | 10/1987 | Meatto et al. | |
| 4,728,116 A | | 3/1988 | Hill | |
| 4,741,550 A | | 5/1988 | Dennis | |
| 4,817,988 A | | 4/1989 | Chauvet et al. | |
| 4,856,808 A | | 8/1989 | Longoni | |
| 4,871,337 A | | 10/1989 | Harris | |

(List continued on next page.)

FOREIGN PATENT DOCUMENTS

| | | |
|---|---|---|
| CH | 681509 A5 | 4/1993 |
| DE | 33 25 819 A1 | 12/1984 |
| DE | 86 05 009.5 | 4/1986 |
| DE | 3628623 A1 | 3/1988 |
| DE | 3806061 A1 | 8/1988 |
| DE | 8903154.7 | 8/1989 |
| DE | 9209879.7 | 10/1992 |
| DE | 29618514 U1 | 2/1997 |
| DE | 19703773 A1 | 8/1998 |
| DE | 19703774 A1 | 8/1998 |
| DE | 29609789 U1 | 10/1998 |
| EP | 0362782 B2 | 4/1990 |
| EP | 0856336 A2 | 8/1998 |
| FR | 2227883 | 4/1974 |
| FR | 2429145 | 1/1980 |
| FR | 2446654 | 8/1980 |
| FR | 2570611 | 3/1986 |

(List continued on next page.)

*Primary Examiner*—Robert P. Olszewski
*Assistant Examiner*—James S. McClellan
(74) *Attorney, Agent, or Firm*—Wolf, Greenfield & Sacks, P.C.

(57) ABSTRACT

A binding mechanism is used to securely couple board sections of a touring snowboard together. The binding mechanism includes a first interface mounted to at least one of first and second board sections and a second interface mounted to the base. A clamp is mounted to the first or second interface and is movable between a closed configuration, wherein the interfaces are adapted to engage with each other, and an open configuration wherein the interfaces are adapted to release each other. When in the open configuration, an amount of clearance exists between the interfaces. When the clamp is moved to the closed configuration, the amount of clearance is decreased to securely join the board sections together. The clamp may also exert a clamping force in at least two non-parallel directions to draw the board sections together. The clamp may also be employed to mount a snowboard boot binding to the board sections when in a snowboard mode, or to one of the board sections when in ascension mode.

45 Claims, 11 Drawing Sheets

U.S. PATENT DOCUMENTS

| | | | |
|---|---|---|---|
| 4,951,960 | A | 8/1990 | Sadler |
| 4,955,632 | A | 9/1990 | Prestipino Giarritta et al. |
| 4,973,073 | A | 11/1990 | Raines et al. |
| 5,028,068 | A | 7/1991 | Donovan |
| 5,035,443 | A | 7/1991 | Kincheloe |
| 5,044,654 | A | 9/1991 | Meyer |
| 5,054,807 | A | 10/1991 | Fauvet |
| 5,069,463 | A | 12/1991 | Baud et al. |
| 5,109,616 | A | 5/1992 | Lush |
| 5,156,644 | A | 10/1992 | Koehler et al. |
| 5,249,816 | A | 10/1993 | Southworth |
| 5,344,179 | A | 9/1994 | Fritschi et al. |
| 5,397,150 | A | 3/1995 | Commier et al. |
| 5,542,197 | A | 8/1996 | Vincent |
| 5,551,728 | A | 9/1996 | Barthel et al. |
| 5,553,883 | A | 9/1996 | Erb |
| 5,558,354 | A | 9/1996 | Lion |
| 5,618,051 | A | 4/1997 | Kobylenski et al. |
| 5,649,722 | A | 7/1997 | Champlin |
| 5,660,416 | A | 8/1997 | Schiele et al. |
| 5,741,023 | A | 4/1998 | Schiele et al. |
| 5,762,358 | A | 6/1998 | Hale |
| 5,765,853 | A | 6/1998 | Erb |
| 5,816,590 | A | 10/1998 | Fey et al. |
| 5,820,139 | A | 10/1998 | Grindl |
| 5,884,933 | A | 3/1999 | Trott |
| 5,906,388 | A | 5/1999 | Neiley |
| 5,941,552 | A | 8/1999 | Beran |
| 5,966,844 | A | 10/1999 | Hellermann et al. |
| 5,984,324 | A | 11/1999 | Wariakois |
| 5,984,325 | A | 11/1999 | Acuna |
| 6,000,711 | A | 12/1999 | Fey et al. |

FOREIGN PATENT DOCUMENTS

| | | |
|---|---|---|
| FR | 2583987 | 1/1987 |
| FR | 2592314 | 7/1987 |
| FR | 2599984 | 12/1987 |
| FR | 2609901 | 7/1988 |
| FR | 2611345 | 9/1988 |
| FR | 2613240 | 10/1988 |
| FR | 2613948 | 10/1988 |
| FR | 2627097 | 8/1989 |
| WO | WO98/17355 | 4/1998 |

* cited by examiner

BINDING MECHANISM FOR A TOURING SNOWBOARD

BACKGROUND OF THE INVENTION

1. Field of the Invention

The invention relates to bindings and other joining apparatuses for use with a touring snowboard having at least two board sections.

2. Related Art

Back country snowboarding involves snowboarding in areas usually away from groomed trails and ski lifts, and offers a rider many unique advantages, including better quality snow and no crowding on the slopes or at ski lifts. However, the snowboarder must ascend a slope without the use of a ski lift. Typically, a rider will remove the snowboard from his or her boots and carry the board up a slope.

To enhance a rider's ability to ascend a mountain, as well as to provide additional recreation for the rider, touring snowboards have been developed wherein the snowboard includes board sections that are releasably joined together. In a snowboarding mode, the board sections are joined together to simulate a unitary snowboard. In an ascension mode, the board sections are separated and operate independently to facilitate ascending a slope.

Various binding systems have been developed for use in conjunction with these touring snowboards. To configure the snowboard in the snowboard mode, a first component of the binding mechanism typically is mounted to a first board section, and a second component of the binding mechanism is typically mounted to a second board section. A component of the binding mechanism that secures the rider's boot slidingly engages with the two components mounted to the board sections. Due to the nature of this arrangement, optimal coupling between the two board sections is not possible. In this respect, a clearance between the two binding components is required in order to effectively slide one component relative the other. This clearance typically causes undesirable play between the components of the binding mechanism, and consequently between the two board sections, during use.

In addition, typical binding systems for touring snowboards utilize separate arrangements, each having independent components, for locking the binding mechanism to the snowboard in the snowboard mode and in the ascension mode. This is disadvantageous as it requires the use of multiple, often complex components to effectively secure the binding mechanism to the board.

SUMMARY OF THE INVENTION

In one illustrative embodiment of the invention, a binding mechanism for a touring snowboard having at least a first and a second board section to be arranged in either a snowboard mode or an ascension mode is provided. The binding mechanism includes a base configured and arranged to receive a snowboard boot. A first interface is mounted to at least one of the first and second board sections and a second interface is mounted to the base and configured and arranged to engage with the first interface when the touring snowboard is in the snowboard mode to mount the base to the snowboard. The first or second interface includes a clamp moveable between a closed configuration wherein one of the first and second interfaces is adapted to engage with the other of the first and second interfaces and an open configuration wherein the one of the first and second interfaces is adapted to release the other of the first and second interfaces, wherein an amount of clearance exists between the first and second interfaces when the clamp is in the open configuration. The amount of clearance is decreased when the clamp moves from the open configuration to the closed configuration.

In another illustrative embodiment of the invention, an apparatus for attaching together first and second board sections of a touring snowboard to be arranged in either of a snowboard mode and an ascension mode is provided. The apparatus includes a first interface portion to be mounted to the first board section and a second interface portion to be mounted to the second board section. A clamp is operatively coupled to the first and second interface portions. The clamp exerts clamping forces on the first and second interface portions in at least two non-parallel directions to draw the first and second board sections together.

In yet another illustrative embodiment of the invention, a binding mechanism for a touring snowboard having at least first and second board sections to be arranged in either of a snowboard mode and an ascension mode is provided. The binding mechanism includes a base configured and arranged to receive a snowboard boot. The binding mechanism further includes at least one snowboard mode interface to mount the base to the snowboard in the snowboard mode and at least one ascension mode interface to mount the base to one of the first and second board sections in the ascension mode. A clamp, which is coupled to base, is moveable between an open configuration and a closed configuration. In the closed configuration, the clamp is adapted to engage with the at least one snowboard mode interface in the snowboard mode and with the at least one ascension mode interface in the ascension mode. When in the open configuration, the clamp is adapted to release the at least one snowboard mode interface in the snowboard mode and to release at least one ascension mode interface in the ascension mode.

In still another illustrative embodiment of the invention, a binding mechanism for a touring snowboard having at least first and second board sections to be arranged in either of a snowboard mode and an ascension mode is provided. The binding mechanism includes a base configured and arranged to receive a snowboard boot and a first interface to mount to at least one of the first and second board sections. A second interface is mounted to the base and configured and arranged to engage with the first interface when the touring snowboard is in the snowboard mode to mount the base to the snowboard. The binding mechanism further includes a means, operatively coupled between the first and second interfaces, for decreasing an amount of clearance between the first and second interfaces to clamp the first interface to the second interface when in the snowboard mode.

In another illustrative embodiment of the invention, an apparatus for attaching together first and second board sections of a touring snowboard to be arranged in either of a snowboard mode and an ascension mode is provided. The apparatus includes a first interface portion to be mounted to the first board section and a second interface portion to be mounted to the second board section. A means, operatively coupled between the first and second interface portions, exerts clamping forces on the first and second interface portions in at least two non-parallel directions to draw the first and second board sections together.

In still another illustrative embodiment of the invention, a method for mounting a snowboard binding to a touring snowboard is provided. The touring snowboard has at least first and second board sections to be arranged in either of a snowboard mode and an ascension mode. The snowboard binding includes a base to receive a snowboard boot and the first board section includes a first interface portion and the second board section includes a second interface portion. The method includes an act of mounting the base to the snowboard in the snowboard mode by clamping the base to the first and second interface portions in a manner that draws the first and second interface portions together to draw the first and second board sections together.

In still another illustrative embodiment of the invention, a method for securing first and second board section of a touring snowboard when in a snowboard mode is provided. The first and second board sections also are separable for use in an ascension mode. The first board section includes a first interface portion and the second board section includes a second interface portion. The method includes an act of clamping together the first and second interface portions by exciting clamping forces on the first and second interface portions in at least two non-parallel directions to draw the first and second board sections together.

In another illustrative embodiment of the invention, a method of converting a touring snowboard having first and second board sections from an ascension mode to a snowboard mode is provided. The touring snowboard has left and right bindings to receive left and right snowboard boots. The method includes the acts of actuating a first moveable clamp on the left binding to disengage the left binding from a left ascension mode interface mounted to the first board section, actuating a second movable clamp on the right binding to disengage the right binding from a right ascension mode interface mounted to the second board section, placing the first and second board sections together, actuating the first moveable clamp on the left binding to engage with a left snowboard interface on at least one of the first and second board sections, and actuating the second moveable clamp on the right binding to engage with a right snowboard interface on at least one of the first and second board sections.

In another illustrative embodiment, a touring snowboard configured to be arranged in either of a snowboard mode and an ascension mode is provided. The touring snowboard cooperates with a binding mechanism to configure the touring snowboard in the snowboard mode. The binding mechanism has a first interface including a first interface portion mountable to the touring snowboard and a second interface portion mountable to the touring snowboard. The touring snowboard includes a first section having at least two mounting holes to receive the first portion of the first interface and a second board section having at least two mounting holes to receive the second portion of the first interface. The mounting holes lie on a circle when the two board sections are joined together.

In still another illustrative embodiment, an apparatus for attaching together first and second board sections of a touring snowboard to be arranged in either of a snowboard mode and an ascension mode is provided. The apparatus includes a first interface portion to be mounted to the first board section and a second interface portion to be mounted to the second board section. The first and second portions together form a circular engagement area. A clamp, operatively coupled to the first and second interface portions, exerts clamping forces on the circular engagement area.

BRIEF DESCRIPTION OF THE DRAWINGS

Various embodiments of the invention will now be described, by way of example, with reference to the accompanying drawings, in which.

DETAILED DESCRIPTION

One illustrative embodiment of the present invention is directed to a binding mechanism for use with a touring snowboard. The binding mechanism includes first and second interfaces, with one of these interfaces being mounted to the binding and the other being mounted to at least one of the board sections. One of the interfaces includes a clamp that securely couples the board sections of the touring snowboard together. The clamp is movable between an open configuration and a closed configuration. To mount the binding mechanism to the snowboard, the clamp is opened and then positioned to engage the other interface. The clamp then is moved to the closed configuration, whereby an amount of clearance between the clamp and the other interface is decreased, thereby drawing the board sections together to securely join them. Advantageously, play between the components of the binding mechanism is reduced when the clamp is closed, thereby reducing play between the two board sections when used in the snowboard mode.

In another embodiment, an apparatus is provided to attach the board sections together. The apparatus employs a clamp that exerts clamping forces in at least two non-parallel directions to draw the board sections together. The apparatus may be configured to also mount the snowboard binding to the touring snowboard. Alternatively, the apparatus may be a separate mechanism to couple the board sections together without also mounting the snowboard binding to the touring snowboard. Providing a clamp that exerts clamping forces in non-parallel directions advantageously draws the board section together in a manner that reduces shearing movement (i.e., in a longitudinal direction) between the two board sections.

In another embodiment, a binding mechanism is provided that employs a clamp to mount a snowboard boot binding to the board sections when in a snowboard mode, or to one of the board sections when in ascension mode. Thus, the binding mechanism employs a single movable engagement for both ascension mode and snowboard mode. This is advantageous as the mechanism reduces complexity.

In another embodiment, the binding mechanism has a first interface including a first interface portion mountable to the touring snowboard and a second interface portion mountable to the touring snowboard. The touring snowboard includes a first section having at least two mounting holes to receive the first portion of the first interface and a second board section having at least two mounting holes to receive the second portion of the first interface. The mounting holes lie on a circle when the two board sections are joined together.

In another embodiment, the first and second portions together form a circular engagement area. A clamp, operatively coupled to the first and second interface portions, exerts clamping forces on the circular engagement area.

Figure 1:
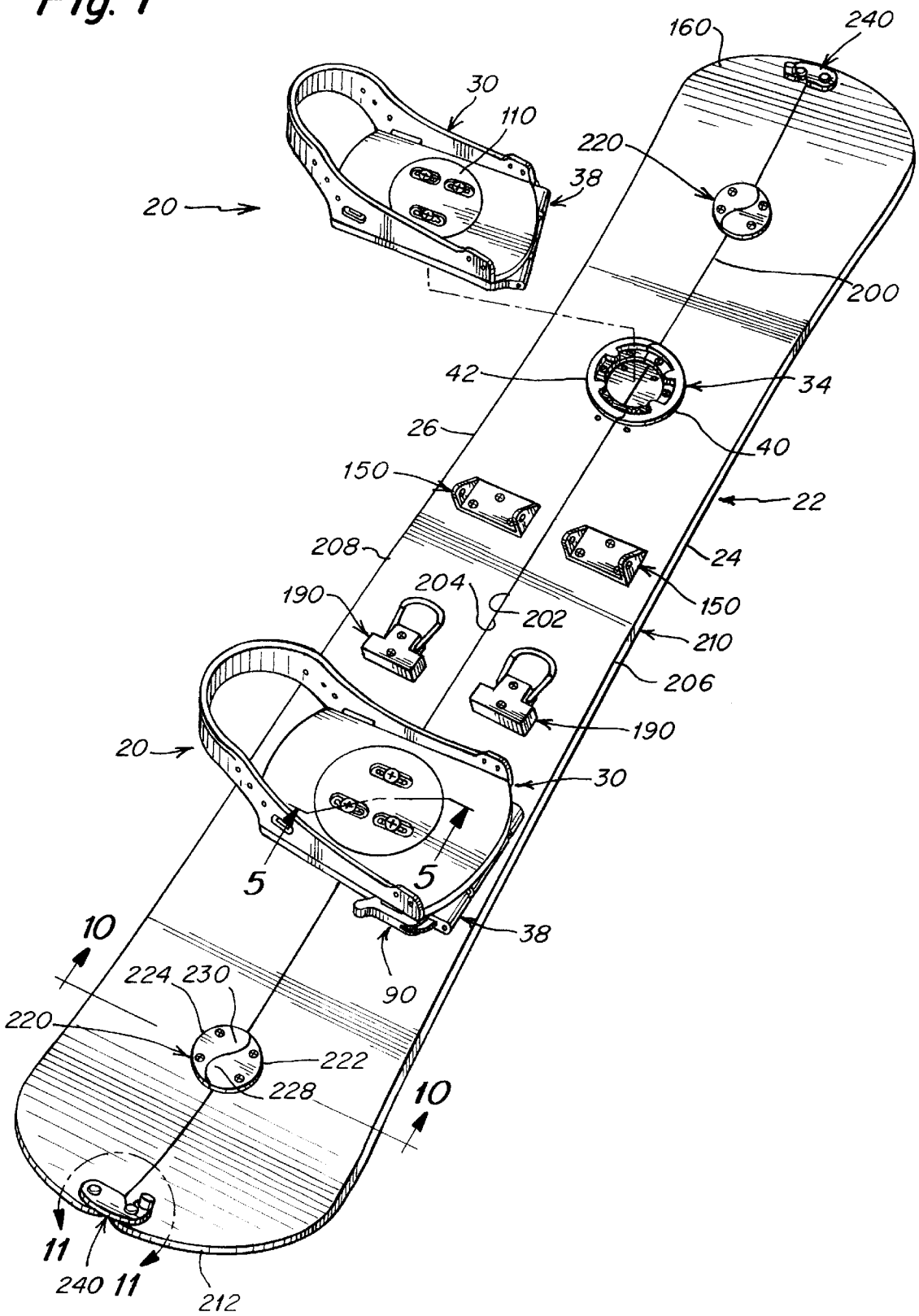
FIG. 1 illustrates a touring snowboard in a snowboard mode and a binding mechanism according to one embodiment of the present invention.
Figure 2:
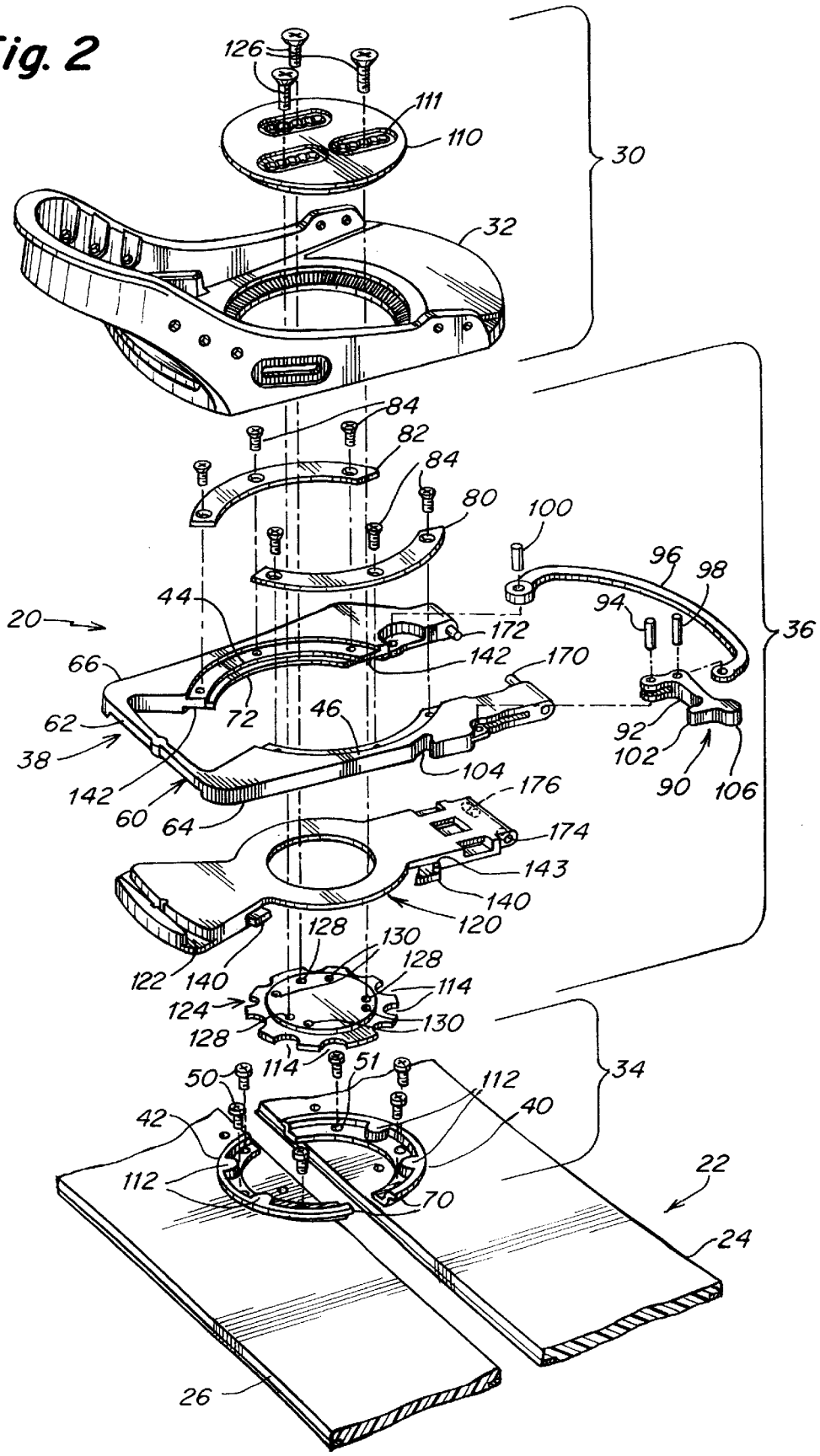
FIG. 2 is an exploded perspective view of the binding mechanism of FIG. 1 and snowboard binding to be attached by the binding mechanism to a touring snowboard.

One illustrative embodiment of a binding mechanism 20 in accordance with the present invention is shown in FIGS. 1 and 2. In this embodiment, the binding mechanism is used to mount a snowboard boot (not shown) to a touring snowboard 22. The touring snowboard includes two board sections 24, 26 that are configurable to be joined in a snowboard mode and to be separated in an ascension mode.

The present invention can be employed with any touring snowboard including two or more sections. Thus, although two board sections are shown and described, it is to be appreciated that the present invention can also be employed with touring snowboards having additional board sections.

Referring to FIG. 2, the binding mechanism 20 includes a snowboard boot binding 30 having a base 32 to receive a snowboard boot. The snowboard boot binding can be of any type, including strap-type tray bindings or step-in bindings, as the present invention is not limited to use with any particular type of binding 30.

The binding mechanism 20 further includes a first interface 34 (also referred to as a snowboard mode interface) mounted to the touring snowboard 22 and a second interface 36 mounted to the base 32 and engageable with the first interface 34 when the touring snowboard is in the snowboard mode. A clamp 38 is operably coupled to the second interface 36 to secure the interfaces 34, 36 together when the touring snowboard 22 is in the snowboarding mode. It should be appreciated that the present invention is not limited to employing the clamp on the interface mounted to the binding, as the clamp could alternatively be provided on the interface mounted to the snowboard.

Figure 3:
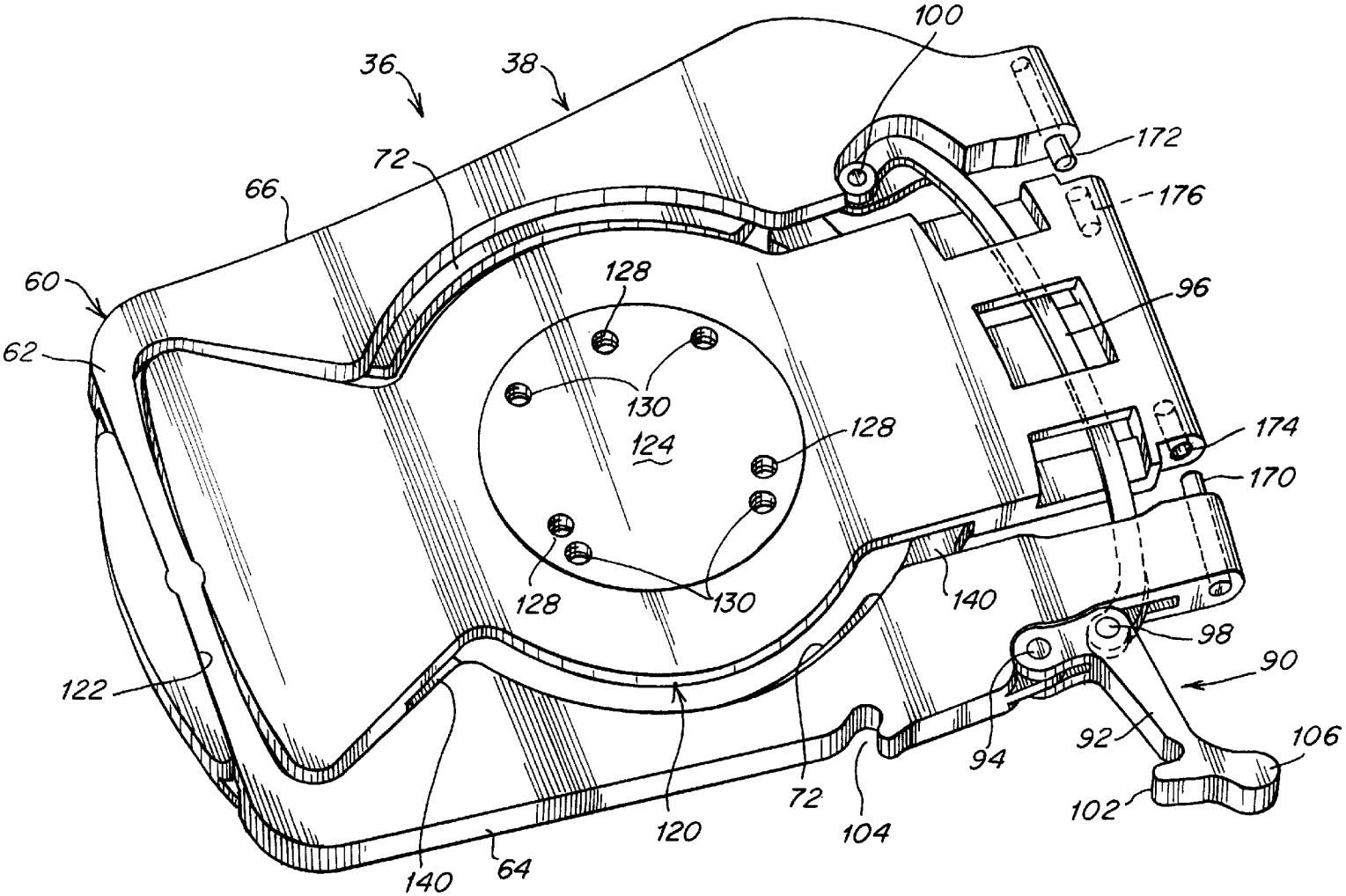
FIG. 3 is an assembled perspective view of the binding mechanism of FIGS. 1–2 in the open configuration.
Figure 4:
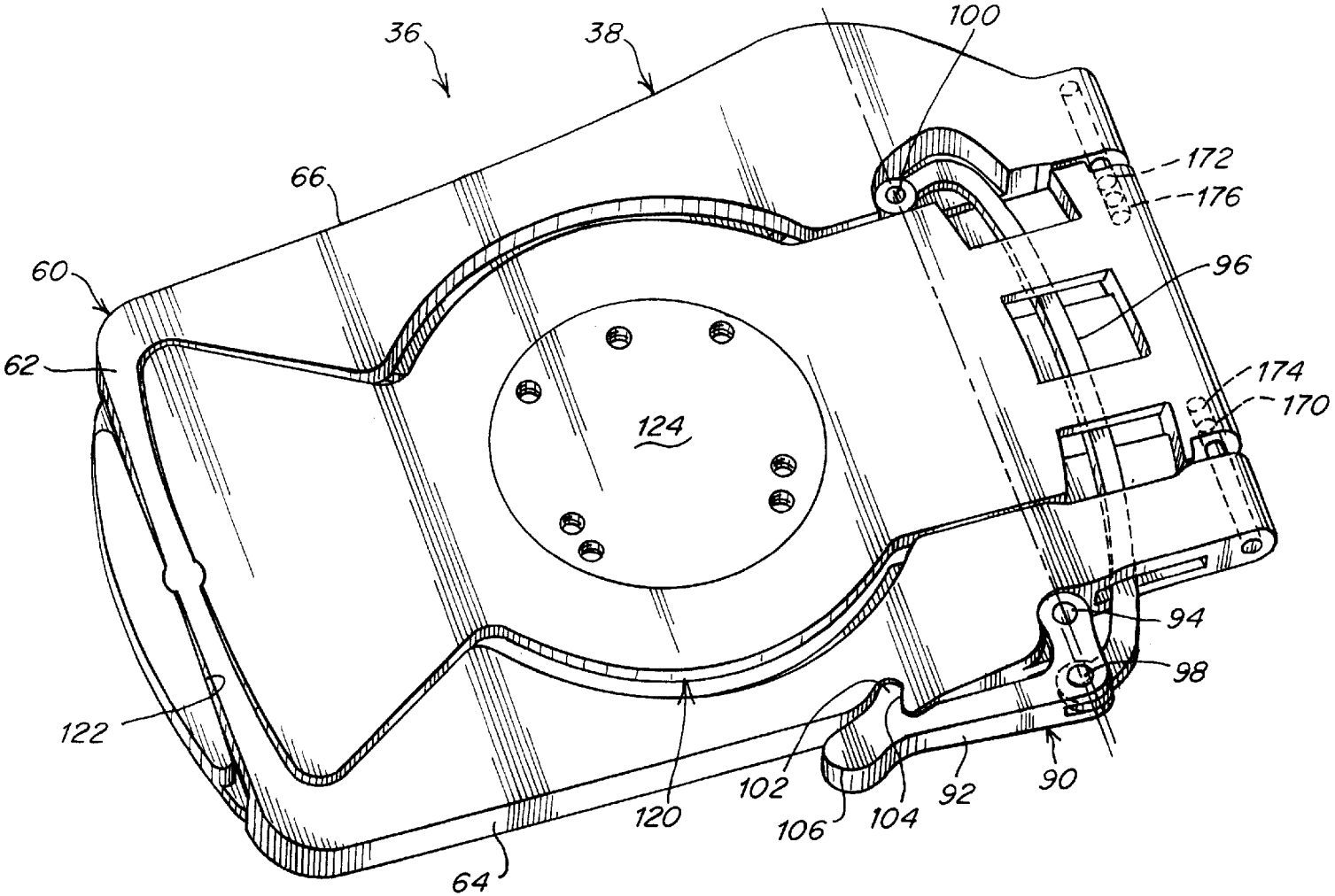
FIG. 4 is an assembled perspective view of the binding mechanism of FIGS. 1–3 in the closed configuration.

The clamp 38 is moveable between an open configuration (see FIG. 3) and a closed configuration (see FIG. 4). In the closed configuration, the interfaces 34, 36 are adapted to engage with each other and in the open configuration, the interfaces 34, 36 are adapted to release each other. In the open configuration, an amount of clearance exists between the interfaces 34, 36. When the clamp 38 moves to the closed configuration, the amount of clearance is decreased. If there is any space between the board sections, the clamping action of the clamp 38 draws the board sections together. In this manner, the board sections 24, 26 are secured together in a way that maintains the structural integrity of the snowboard 22 when in the snowboarding mode. In contrast, earlier binding mechanisms employed sliding engagement between components of the mechanism. Necessarily, in order to provide such sliding engagement, undesirable clearance must exist between the components. According to this embodiment of the present invention, a clamp is employed to reduce any clearance between the components of the binding mechanism.

In the embodiment shown in FIG. 2, the first interface 34 includes two half-disks 40, 42, each being crescent-shaped. One half-disk 40 is mounted to one board section 24 and the other half-disk 42 is mounted to the other board section 26. The outer periphery of the half-disks 40, 42 together form a complete circle and defines a circular engagement area. The clamp 38 includes mating arc-shaped portions 44, 46 having substantially the same radius of curvature as the outer periphery of the half-disks 40, 42 to engage therewith.

It should be appreciated that the present invention is not limited to using circular mating surfaces on the interfaces, as other suitably shaped mating surfaces may be employed. For example, oval-shaped, rectangular-shaped, square-shaped, triangular-shaped, other polygon-shaped or any other suitably shaped mating surface may be employed. In addition, although the interface 34 is formed from half-disks 40, 42 occupying an annular region (i.e., each is crescent shaped), it is to be appreciated that the interface 34 may be formed from other suitably shaped members. Further, although the half-disks 40, 42 are shown to be approximately equal in size, the present invention is not limited in this respect, as one half-disk may be larger than the other.

Each half-disk 40, 42 may be mounted to a respective board section by any suitable fastener, as the invention is not limited to any particular attachment technique. For example, in one embodiment, the half-disks 40, 42 are mounted to the board with the use of screws 50 passing through holes 51 in the half-disks and engaging threaded inserts 52 embedded into the board sections 24, 26. In one illustrative embodiment, the half-disks are mounted to the board with the use of a hole pattern arranged on a circle. For example, each board section includes at least two mounting holes arranged in a manner such that when the board sections are joined together, the resulting four mounting holes lie substantially on a circle. In the embodiment shown, three mounting holes formed on each board section are employed and are arranged in a manner such that when the board sections are joined together, the resulting six mounting holes lie substantially on a circle. Arranging the mounting holes for the half-disks on a circle is advantageous because the stress induced on the half-disks may be equalized. In this respect, the mounting holes follow the contour of the crescent shaped half-disks and the stress at each mounting location is about the same. Although the mounting holes are positioned to lie on a circle in one embodiment, the present invention is not limited in this respect, as other suitable mounting positions may be employed.

The half-disks may be adjustably mountable to the board such that the stance width of the rider's feet may be adjusted. Thus, in one embodiment, the board is constructed with multiple sets of mounting holes each having a threaded insert 52 to receive a screw 50. The half-disks thus may be mounted in one of a plurality of locations along the length of the board. Alternatively, a plurality of mounting holes may be formed in the half-disks to allow adjustable mounting of the half-disks to accommodate a desired stance width.

In one embodiment of the invention, relative vertical movement between the board sections is inhibited when the board sections 24, 26 are joined together. This can be done in any of numerous ways. In the illustrative embodiment shown in FIGS. 1 and 2, the half-disks 40, 42 are mounted to the board sections 24, 26 such that a portion of the half-disk 40 that is mounted to the first board section 24 overlies the surface of the second board section 26. Similarly, a portion of the half-disk 42 that is mounted to the second board section 26 overlies the surface of the first board section 24. In this respect, the portion of each half-disk that overlies the adjacent board section prevents that board section from raising relative to the board section to which the half-disk is mounted. Although in the embodiment shown each half-disk overlies the adjacent board section, in an alternative embodiment, only one half-disk overlies the adjacent board section. In addition, as discussed above, relative vertical movement between the board sections can be inhibited in other ways, so that neither half-disk need overlie the adjacent board section.

To facilitate clamping about the half-disks, the clamp 38 includes a U-shaped member 60 having a base portion 62 and first and second arms 64, 66 joined to opposite sides of the base portion 62. The first and second arms 64, 66 each engages portions of the first and second half-disks 40, 42, with the arms 64, 66 respectively including the above-discussed arc-shaped portions 44, 46 that engage the half-disks 40, 42. It is to be appreciated that although the clamp is shown as a U-shaped clamp member, the present invention is not limited in this respect, as other suitably shaped clamps may be employed. In addition, although the arms 64, 66 include arc-shaped portions 44, 46 that engage the half-disks 40, 42, it is to be appreciated that any suitably shaped arms 64, 66 may be employed that is compatible with the shape of the outer periphery of the half-disks.

Figure 5:
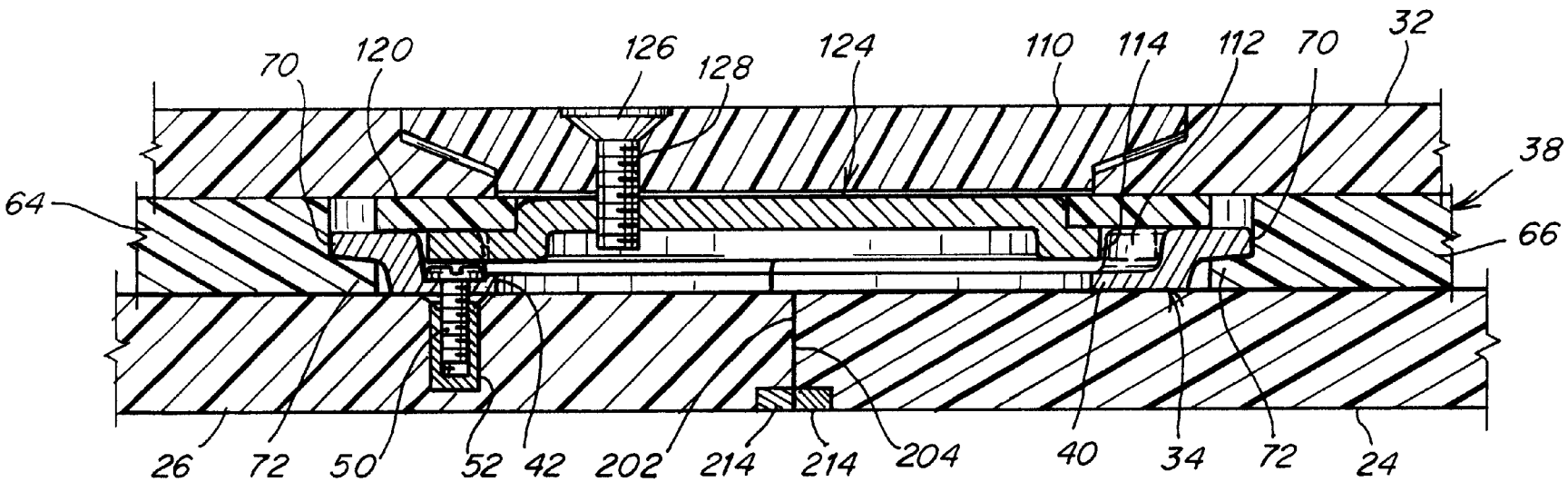
FIG. 5 is a cross-sectional view of a portion of the binding mechanism of FIGS. 1–4, taken along line 5—5 of FIG. 1, showing interengagement of the components of the binding mechanism.

Preferably, the clamp 38 engages the half-disks 40, 42 in a manner such that when the clamp 38 is in the closed configuration, lifting forces imparted to the binding mechanism 20 are resisted. This can be done in any of numerous ways. In the illustrative embodiment shown in FIG. 5, which is a cross-section of a portion of the binding mechanism taken along line 5—5 of FIG. 1, each half-disk includes a lobe 70 and the first and second arms 64, 66 of the clamp 38 each includes a mating shelf 72 that engages with the lobe 70. Although a lobe and shelf configuration is provided, the present invention is not limited in this respect as other suitable engaging features may be provided to resist lifting of the clamp 38 from the half-disks 40, 42. For example, the half-disks may include detents and the clamp may include mating protrusions.

In the embodiment shown, the clamp 38 is biased toward the open configuration to facilitate engagement between the clamp 38 and the first interface 34. This can be done in any of numerous ways. For example, the side arms 64, 66 of the U-shaped member 60 may be biased toward an outward direction so that clearance is provided to enable the U-shaped member 60 to engage the half-disks 40, 42. To close the clamp 38, the bias of the U-shaped member 60 is overcome so that the side arms 64, 66 are moved toward each other to engage the half-disks 40, 42.

In the embodiment shown, the U-shaped member 60 is biased toward the open configuration due to the shape of the U-shaped member 60. For example, the base 62 and/or one or both side arms of the U-shaped member 60 may be formed as a leaf spring that biases the side arms 64, 66 away from each other. Of course, other suitable arrangements to bias the U-shaped member 60 may be employed, as the invention is not limited to any particular biasing technique. For example, a separate spring may be employed, with the side arms 64, 66 being pivotally mounted to the base portion 62. In addition, the U-shaped member need not be biased to the open configuration.

In one embodiment, the binding mechanism 20 of the present invention is a low profile, light-weight component that minimizes interference with the performance and feel of the touring snowboard 22 when in either mode. The U-shaped member 60 may be formed of a plastic material, such as nylon, which may be fiber filled (e.g., glass fibers) for increased strength. When formed of such material, reinforcing inserts 80, 82 may be employed to reinforce the side arms 64, 66 that engage with first interface. In the embodiment shown, the inserts 80, 82 each is a crescent-shaped component that is fastened to a side arm with the use of screws 84 or is otherwise secured thereto. For example, the inserts may be co-molded with the U-shaped member. The inserts may be formed of a metal, such as steel or aluminum, although other suitable materials may be employed. In addition, it should be appreciated that other materials alternatively may be used to form the U-shaped member 60, such as a polymer (e.g., carbon composites or a polycarbonate), a metal (e.g., steel or aluminum), or any combination of materials as the present invention is not limited to the use of any particular material.

As previously mentioned, the binding mechanism is a low-profile component. Thus, in one illustrative embodiment, the thickness of the second interface ranges between approximately 5 mm and approximately 12 mm. In one embodiment, the thickness of the second interface is approximately 10 mm, although other suitable thicknesses may be employed.

To facilitate moving the side arms 64, 66 of the U-shaped member 60 to move the clamp 38 to the closed configuration, a lock 90 is coupled to the U-shaped member 60. As shown in FIGS. 2–4, the lock 90 includes a lever arm 92 pivotally coupled to the first arm 64 about a first pivot pin 94 whereby the lever arm 92 may pivot between an open position (see FIG. 3) and a closed position (see FIG. 4). A link 96 is pivotally coupled to the lever arm 92 about a second pin 98 and is also pivotally coupled to the second arm 66 about a third pivot pin 100. The lever arm 92 extends from the outer periphery of the binding mechanism 20 as well as away from the snowboard binding 30 and may include a handle 106 or grip area to facilitate ease of grasping. When moving to the closed position, the lever arm 92 is arranged to draw the second arm 66 toward the first arm 64 via the link 96.

In the embodiment shown, the link 96 is a rigid member, (e.g., formed of steel, aluminum or other suitable material) formed generally along an arc and having a rectangular shaped cross-section. The rigidity of the link 96 aids in pushing the arms 64, 66 away from each other as the lever arm 92 is pivoted to move the clamp 38 from the closed configuration to the open configuration. However, it is to be appreciated that the present invention is not limited in this respect and that a rigid link need not be employed. For example, a cable or other suitable metal or plastic wire or line may be used to move the second arm 66 to the closed configuration. When it is desired to move the clamp 38 to the open configuration, the lever arm 92 is pivoted in a direction to relieve the tension on the link 96, wire or line and the second arm 66 moves away from the first arm 64 under the action of the spring bias as mentioned above. If a spring bias is not employed, then, as the clamp 38 is moved to the open configuration, the lever arm 92 pushes the link 96 and subsequently the arms 64, 66 away from each other.

In one embodiment, the binding mechanism 20 includes a mechanism to ensure that once the clamp 38 is engaged with the interface 34 and the lever arm 92 is in a closed position, the lever arm 92 will remain in the closed position and will not be inadvertently opened. This can be done in any of numerous ways, as the invention is not limited to any locking technique or even to employing any lock at all. In one embodiment, the lock 90 may be configured as an over-center lock whereby forces that tend to move the clamp to the open configuration act to maintain the lock in the closed position. In one illustrative embodiment, to form such an over-center lock, the link 96 is shaped along an arc. In this respect, as shown in FIG. 4 the pivot point (defined by pivot pin 98) of the link 96 and the lever arm 90 is able to pass through a line extending between the pivot pin 100 and pivot pin 94 because the link 94 does not interfere with the lever arm. Thus, opening forces exerted on the link 96 act to pivot the lever arm 92 toward the closed position. In another illustrative embodiment, to maintain the lock in the closed position, the lever arm 92 includes a locking tab 102 and the first arm 64 includes an engaging recess 104, which receives the locking tab 102 when the lever arm 92 is in the closed position.

Although the lock 90 may be configured as an over-center lock, the present invention is not limited in this respect as other suitable locking arrangements may be provided. In addition, although the lock 90 used to move the clamp 38 includes a link 96 and a lever arm 92, the present invention is not limited in this respect, as other suitable arrangements may be used to draw the two arms 64, 66 toward each other. In addition, a lock 90 need not be employed at all. In this respect, the side arms 64, 66 of the clamp 38 may be moved toward each other by manual means. Further, although a single lever arm 92 is used in the embodiment shown, multiple lever arms having one or more links may be employed to move the clamp to at least the open and/or closed configuration.

The clamping force exerted by the U-shaped member may be a function of the amount of movement of the arms 64, 66 relative to the interface 34 wherein a greater amount of movement may correlate to one clamping force whereas a smaller amount of movement may correlate to another clamping force. This clamping force may change with repeated use of the binding mechanism due to, for example, wearing of components, elongation of components, misalignment of components, as well as other situations that may arise with repeated use. For example, the shape of the arc-shaped link 96 may tend to straighten with repeated use of the binding mechanism causing a greater amount of movement in the side arms to clamp to the interface 34. To adjust the amount of clamping force, in one illustrative embodiment, the amount of movement of the side arms may be adjusted. For example, the base 62 may be configured as an adjustable length member where a shorter base would tend to cause an increase in the clamping force whereas a longer base would tend to cause a decrease in the clamping force.

In one embodiment, the base 62 may be configured as a two-member component, with one component being movable relative to the other. For example, the base 62 may be configured in a manner similar to a turn-buckle in which the length of the base may be adjusted by rotating one component of the base relative to the other. It is to be appreciated that the present invention is not limited in this respect, as other suitable arrangements for adjusting the length or adjusting the clamping force may be employed. In addition, the present invention is not limited to employing an arrangement to adjust the clamping force.

As is well-known in the field of snowboarding, it is desirable to enable the stance angle of the binding that receives the snowboard boot to be positioned in any one of a plurality of stance angle positions. As in conventional bindings, this is accomplished via the base 32 of the snowboard binding 30 cooperating with a hold-down disk 110, wherein the base is rotatable relative to the hold-down disk 110 in any one of a plurality of angular positions. In the illustrative embodiment shown, the stance angle advantageously may be adjusted without effecting the stance width, so that these two positions can be set independently. This may be accomplished in the present invention because the stance angle is determined by the hold-down disk, whereas the stance width is determined by the mounting locations of the half-disks relative to each other.

The hold-down disk 110 may further be employed to adjust the heel-to-toe position of the binding relative to the interface. This may be accomplished, as in conventional snowboard bindings, with the use of slotted holes 111 formed in the hold-down disk.

The second interface 36 (which is coupled to the snowboard binding base 32) is coupled to the first interface 34 in a manner that prevents rotation of the clamp 38 about the half-disks 40, 42 when the clamp 38 is in the closed configuration. This may be accomplished in any of numerous ways, as the present invention is not limited to any particular arrangement and other suitable anti-rotation arrangements may be employed. In one embodiment, the clamp 38 exerts a clamping force that is sufficient to prevent relative rotation between the first and second interfaces 34, 36. In another illustrative embodiment, the half-disks 40, 42 include an anti-rotation feature, such as tabs 112 that cooperate with mating notches 114 formed on the second interface 36. Although notches and mating tabs are described, the present invention is not limited in this respect For example, the shape of the half-disks 40, 42 and mating arc-shaped portions 44, 46 of U-shaped member 60 may be non-circular so that the outer periphery of the half-disks 40, 42 acts to maintain the clamp 38 in the desired orientation.

The tabs and mating notches may also be used as an indexing feature to align the interface in a suitable orientation relative to the touring snowboard. In one illustrative embodiment, the tabs and mating notches are located in positions that allow the binding mechanism to be positioned in one of two positions, one being 180° out of phase from the other. By providing such symmetric orientation of the binding mechanism relative to the board, the half-disks may be identical to each other and thus are not shaped based upon the particular board section on which the half-disk is mounted. Advantageously, manufacturing and assembly complexity may therefore be reduced. It should be appreciated that the present invention is not limited in this respect as other suitable arrangements may be employed.

To facilitate securing the binding mechanism to the touring snowboard if the underside of the binding mechanism contains snow and/or ice, the tabs 112 and mating notches 114 may be shaped to cause any snow and/or ice accumulation to be removed upon securing the clamp 38 to the half-disks. This may be accomplished by providing the tabs 112 with a radius of curvature that is less than the radius of curvature of the notches 114. It should be appreciated that the present invention is not limited in this respect as other suitable arrangements for removing snow and/or ice may be employed. In addition, the invention is not limited to employing an arrangement to remove snow and/or ice accumulation.

To hold the U-shaped member 60 to the snowboard binding base 32, a carrier 120 may be employed. The base portion 62 of the U-shaped member 60 is mounted within a recess 122 in the carrier 120 and the carrier 120 is constructed to mount to the base 32 of the snowboard boot binding 30. To mount the carrier 120 to the base 32, in one illustrative embodiment, the carrier 120 includes a carrier disk 124 that is securable to the snowboard binding base 32 with the use of fasteners, such as screws 126 that pass through the hold-down disc 110 and engage with threaded holes 128 in the carrier disk 124. The carrier 120 is thereby sandwiched between the carrier disk 124 and the base 32 of the snowboard binding 30. In one embodiment, the carrier 120 is formed of nylon, although other suitable materials (e.g., a polymer, such as carbon composites or a polycarbonate, a metal, such as steel or aluminum, or any combination of materials) may be used.

The threaded holes 128 may be formed in the carrier disk 124 at locations that correspond to the mounting holes formed in the hold-down disk 110 of the snowboard binding 30. Snowboard bindings conventionally are provided with hole patterns that are compatible with the three-hole pattern provided on a snowboard from the Burton Corporation and/or a 4×4 hole pattern provided on snowboards from other manufacturers. The holes 128 can be provided to be compatible with either of these patterns, or any other hole pattern that may be provided in the snowboard binding 30. In one embodiment of the invention, the carrier disk 124 advantageously includes three holes 128 that are compatible with the three-hole pattern from the Burton Corporation, and four holes 130 compatible with the 4×4 hole pattern.

As mentioned above, the second interface 36 includes the anti-rotation feature and the indexing feature to engage with the half-disks 40, 42. In the illustrative embodiment shown, the carrier disk 124 includes the notches 114 that mate with the tabs 112 on the half-disk 40, 42.

Although a carrier disk 124 is shown and described, it should be appreciated that the present invention is not limited in this respect and that a carrier disk need not be employed. Thus, the hole pattern and anti-rotation and indexing features, if implemented, may be directly formed on the carrier 120.

To provide increased structural integrity between the snowboard boot binding 32 and the snowboard 22, the clamp 38 and the carrier 120 are constructed to span between the board sections 24, 26. In this manner, the binding mechanism 20 increases the structural integrity of the touring snowboard 22 when the board is in the snowboard mode. In addition, one embodiment of the binding mechanism of the present invention advantageously maintains the board's responsiveness to rider's movements and maintains rider sensitivity to changes in terrain because the carrier and U-shaped member cooperate with the snowboard binding 30 in a manner such that substantially the entire baseplate 32 is supported by the carrier and the U-shaped member. As a result, rider movements are transferred to the board in an efficient manner. Similarly, terrain changes as the rider traverses the surface are efficiently sensed by the rider. In prior binding mechanisms for touring snowboards, rider induced movements or changes in terrain would be dampened because the entire snowboard binding was not supported above the touring snowboard. It should be appreciated that although full support of the binding is advantageous, the present invention is not limited in this respect, as other mounting arrangements may be employed.

Figure 6:
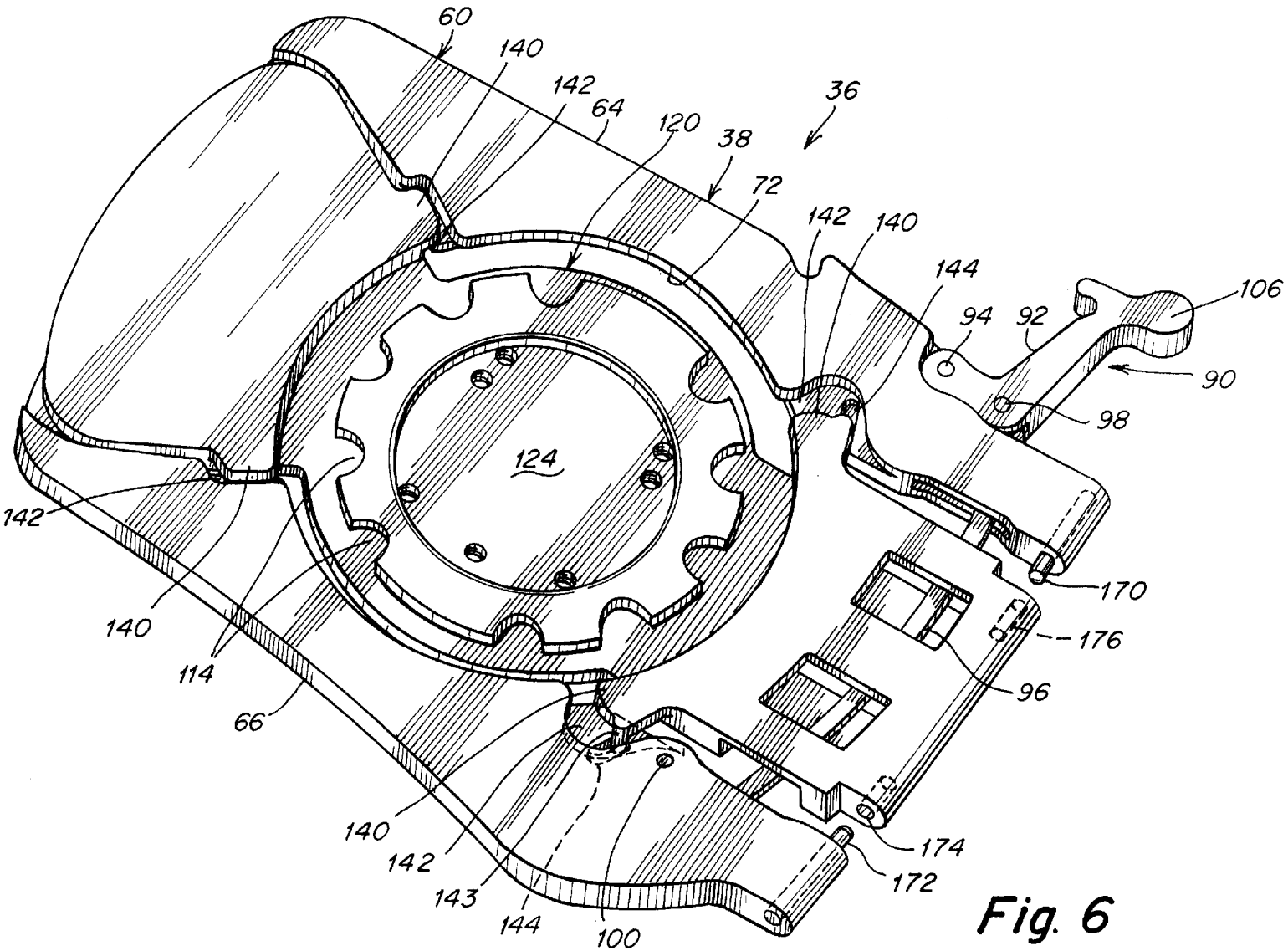
FIG. 6 is an assembled perspective view of the underside of the binding mechanism of FIGS. 1–5.

The carrier 120 is also configured to transfer forces between the first interface 34 and the snowboard boot binding 30. In one illustrative embodiment shown in FIG. 6, which is an underside view of the binding mechanism 20, the carrier 120 includes four shelves that each is engageable with a mating lobe 142 on the U-shaped member 60 at least when the clamp 38 is in the closed configuration. The shelves 140 on the carrier 120 engage lobes 142 formed on the side arms 64, 66 of the U-shaped member 60 so that forces between the carrier 120 and the U-shaped member 60 are transferred. The lobes 142 that engage the shelves 140 may be used as an alternative to the reinforcing inserts 80, 82 or may be used in addition to the reinforcing inserts for added structural integrity. A groove 144 may be formed in a lobe 142 and a mating pin 143 may extend from the shelf 140 to engage within the groove 144. This may be desirable to limit the range of movement of clamp 38 relative to the carrier 120, as well as to provide symmetric opening of the clamp. Although four shelves 140 are described, the present invention is not limited in this respect, as a different number of shelves or no shelves at all may be employed.

As should be appreciated from the foregoing, the clamp 38 exerts clamping forces on the first interface 34 in at least two non-parallel directions. In this manner, the board sections 22, 24 are drawn together. In addition, longitudinal shifting of a board section relative to another may be reduced or prevented. The circular shape of the arc-shaped portions 44, 46 may be helpful in securing the interface 34 in at least two non-parallel directions. In this respect, forces are exerted in directions that are normal to the curve of the arc-shaped portions at any given location. It should be appreciated that the present invention is limited to the particular clamp shown, as other suitable clamp configurations may be employed that exerts clamping forces in at least two non-parallel directions.

In the embodiment discussed above, the clamp 38 that exerts forces in non-parallel directions is also employed to mount the snowboard binding 30 to the touring snowboard. However, the present invention is not limited in this respect, as the benefits of non-parallel clamping can be achieved separately from attaching a binding to the board. Thus, in another embodiment of the invention, a separate apparatus may be employed that employs a clamp that exerts forces in non-parallel directions without also being employed to mount the binding 30 to the touring snowboard.

In one illustrative embodiment, shown in FIGS. 1, 7, 7A and 8, the binding mechanism includes third interfaces 150 (also referred to as ascension mode interfaces), each of which is secured to a board section. The ascension mode interface 150 includes a base portion 152 having upstanding side walls 154, 156. The base portion 152 is secured to the board section with the use of suitable fasteners such as screws 158 engaging threaded inserts disposed in the board section. The ascension mode interface 150 is positioned along the longitudinal length of the board section at a location suitable for allowing the rider to efficiently utilize the board sections to ascend a slope. Thus, the ascension mode interface may be positioned slightly toward the tip 160 of the board section, slightly toward the tail of the board section or in the waist area of the board section. Other suitable mounting locations may be employed. In addition, the board sections may be configured with multiple sets of mounting holes to allow the rider to select the mounting position of the ascension mode interface.

The ascension mode interface 150 includes holes 162, 164 or other suitable receptacles formed in the upstanding side walls 154, 156 to receive a portion of the clamp 38. In one embodiment, the clamp 38 includes pins 170, 172 (see also FIG. 2) laterally extending from each side arm 64, 66 of the U-shaped member 60 to engage with the holes 162, 164 in the ascension mode interface 150. When the clamp 38 is in the closed configuration, the pins 170, 172 engage within the holes 162, 164, respectively, of the ascension mode interface 150 to secure the snowboard boot binding 30 thereto. When the clamp 38 is in the open configuration, the pins 170, 172 release from holes 162, 164 respectively to disengage the snowboard boot binding 30 from the ascension mode interface 150.

Figure 7:
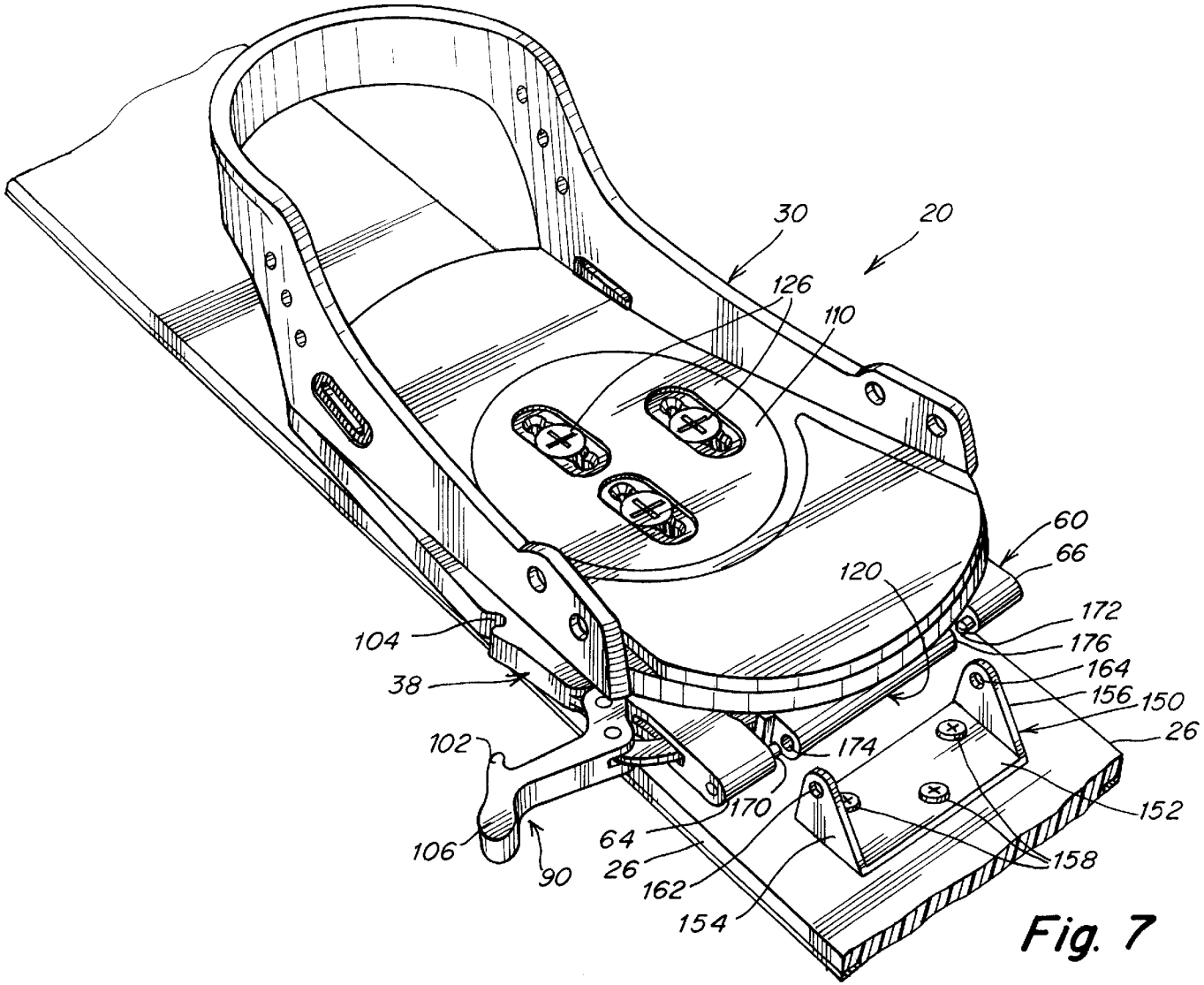
FIG. 7 is a perspective view of the binding mechanism of FIGS. 1–6 in the open configuration when in the ascension mode.
Figure 7A:
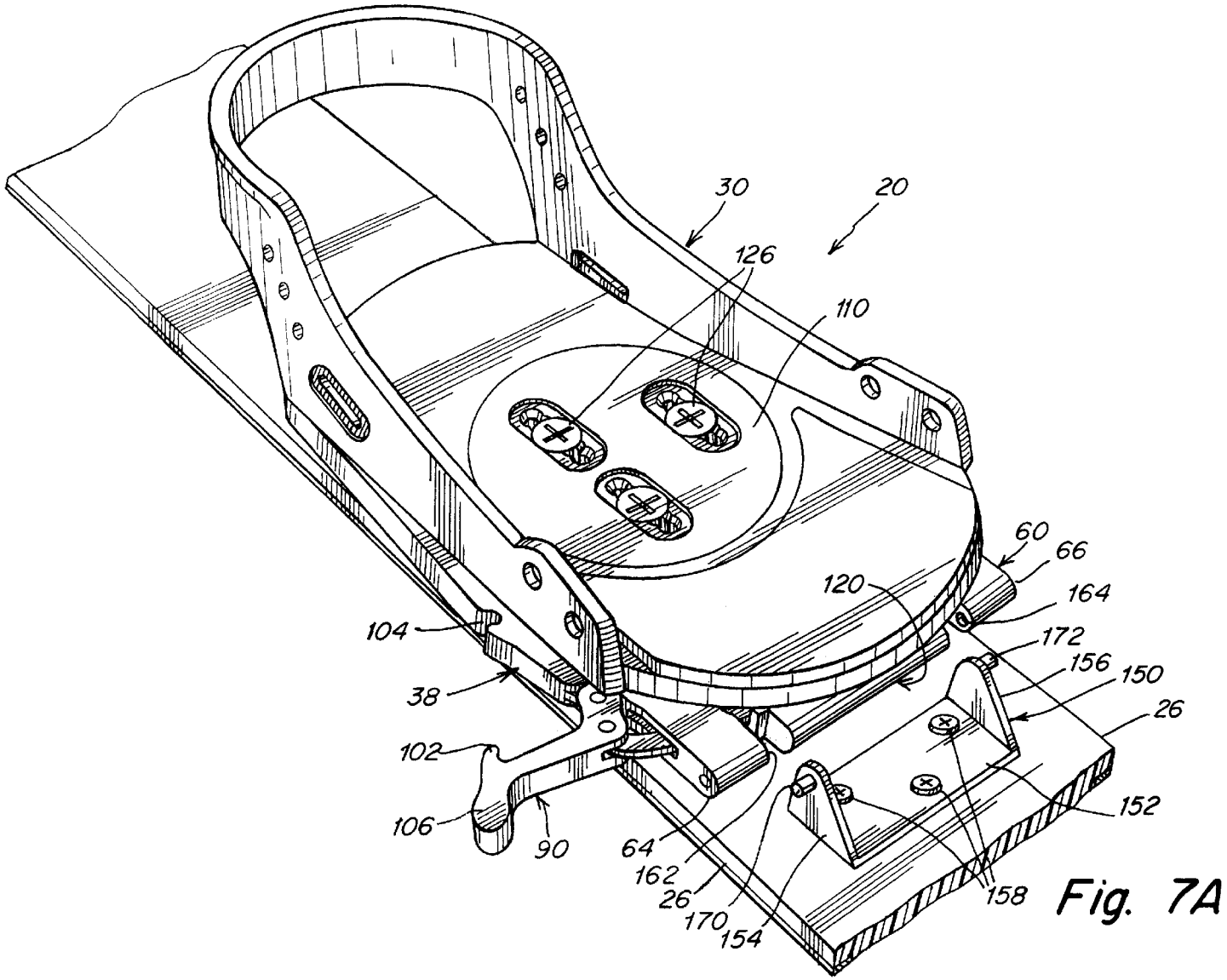
FIG. 7A is a perspective view of an alternative embodiment of the binding mechanism of FIG. 7.
Figure 8:
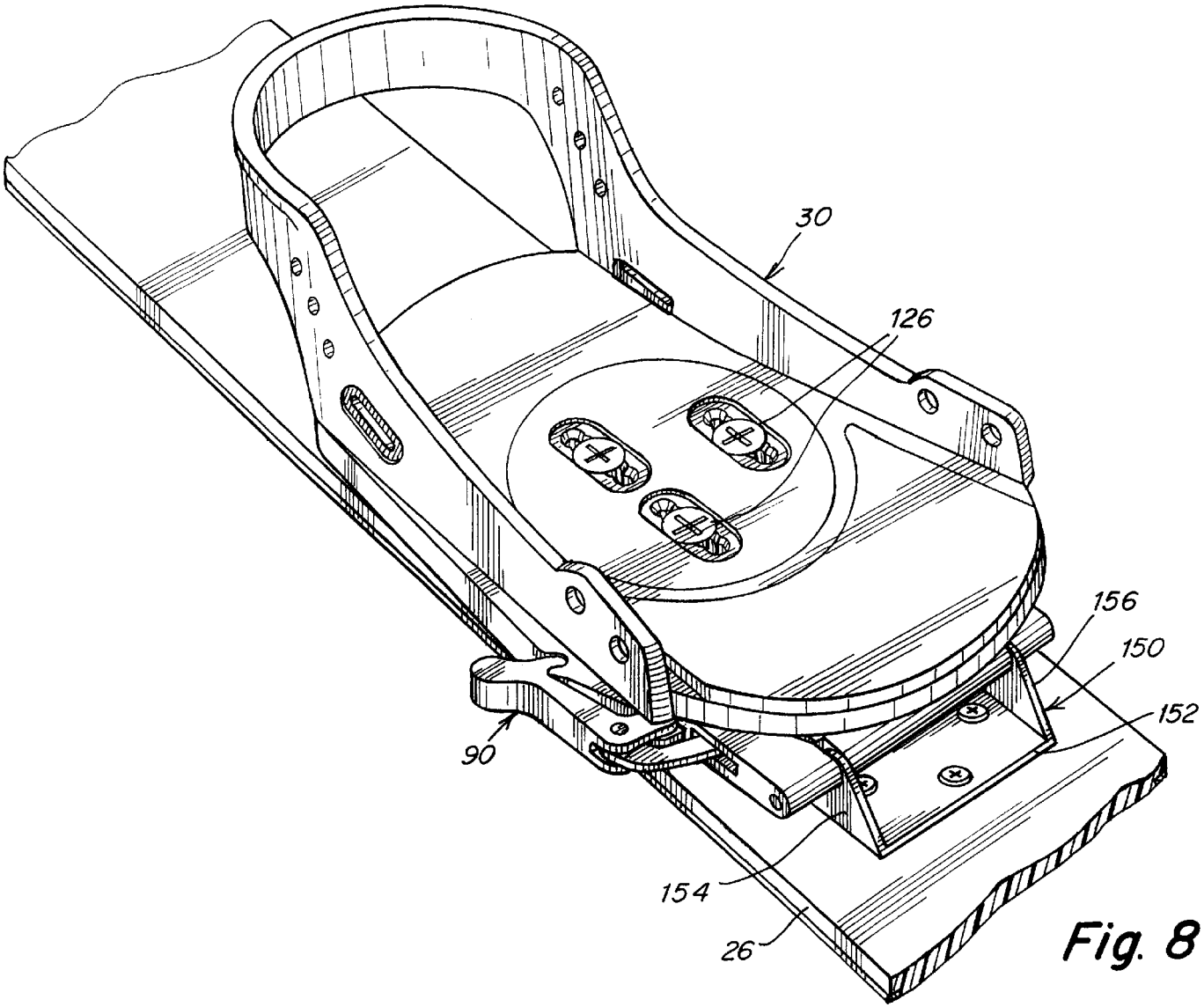
FIG. 8 is a perspective view of the binding mechanism of FIGS. 1–7A in the closed configuration when in the ascension mode.

Although the holes 162, 164 are formed on the ascension mode interface 150 and the pins 170, 172 are formed on the clamp 38, as shown in FIG. 7A, the present invention is not limited in this respect and that the pins may be formed on the ascension mode interface whereas the holes may be formed in the clamp. In addition, other suitable mechanisms for attaching the clamp to the ascension mode interface can be employed, as the invention is not limited to any particular attachment structure.

When in the ascension mode, it is preferable to provide pivoting motion of the binding mechanism 20 relative to the board to facilitate ease of ascending the slope. This may be accomplished with the use of the above-mentioned pins 170, 172, and the holes 162, 164 formed in the ascension mode interface 150, so that the binding mechanism 20 pivots about an axis passing through the pins 170, 172.

As can be readily appreciated, when the clamp 38 is moved from the open configuration (see FIG. 7) to the closed configuration (see FIG. 8), the pins 170, 172 are moved from a position wherein the clamp 38 may be positioned over the ascension mode interface 150 to a position wherein the pins 170, 172 engage within the holes 162, 164 of the ascension mode interface 150. For added structural integrity, the carrier 120 may optionally includes holes 174, 176 formed therein that are aligned with and receive the pins 170, 172 when the clamp 38 is in the closed configuration. In this manner, the ascension mode interface 150 is secured between the clamp 38 and the carrier 120.

When in the ascension mode, the snowboard binding 32 is suitably oriented relative to the interface 36 such that the longitudinal axis of the snowboard binding 32 may be substantially perpendicular with the pivot axis defined by the pivot pins 170, 172 and the holes 162, 164 of the ascension mode interface. The use of the above-mentioned indexing feature allows for the maintenance of the angular orientation of the snowboard binding 32 in the desired stance angle position when converting between the ascension mode and the snowboard mode. For example, when converting to the snowboard mode, the notches 114 engage with the tabs 112 to position the snowboard binding in the previously set stance angle position.

In addition, the longitudinal axis of the snowboard binding 30 may be rotated relative to the U-shaped member such that the pivot axis is no longer substantially perpendicular with the longitudinal axis of the snowboard binding. Thus, a rider may wish to cant the snowboard binding relative to the board section when in ascension mode to accommodate the rider's preference or comfort level. In one illustrative embodiment, this may be accomplished because the U-shaped member is sandwiched between the base 32 of the snowboard binding 30 and the carrier disk 124 and is held due to the forces exerted by the screws 126.

In embodiments discussed above, the same components are utilized to position the rider in the snowboard mode as in the ascension mode. In this manner, according to one embodiment of the present invention, the rider may simply and conveniently convert between modes by disengaging the clamp 38 from the half-disks 40, 42 when in the snowboard mode, rearranging the touring snowboard to the ascension mode and re-clamping the clamp 38 to a board section 24, 26. Utilizing the same components reduces manufacturing complexity and cost of the system, as it is not necessary to employ two completely independent closure mechanisms.

When ascending a slope while in the ascension mode, the toe area of a rider's foot may be higher than the heel area such that the rider's foot is dorsi flexing. In this situation, it may be desirable to reduce the likelihood of hyperextending the rider's Achilles tendon. To accomplish this, in one illustrative embodiment as shown in FIGS. 1 and 9, a heel lift 190 is mounted to each board section and is engageable with the heel end 192 of the snowboard boot binding or, as shown, the interface 36, to raise the heel end 192 relative to the toe end 194.

Figure 9:
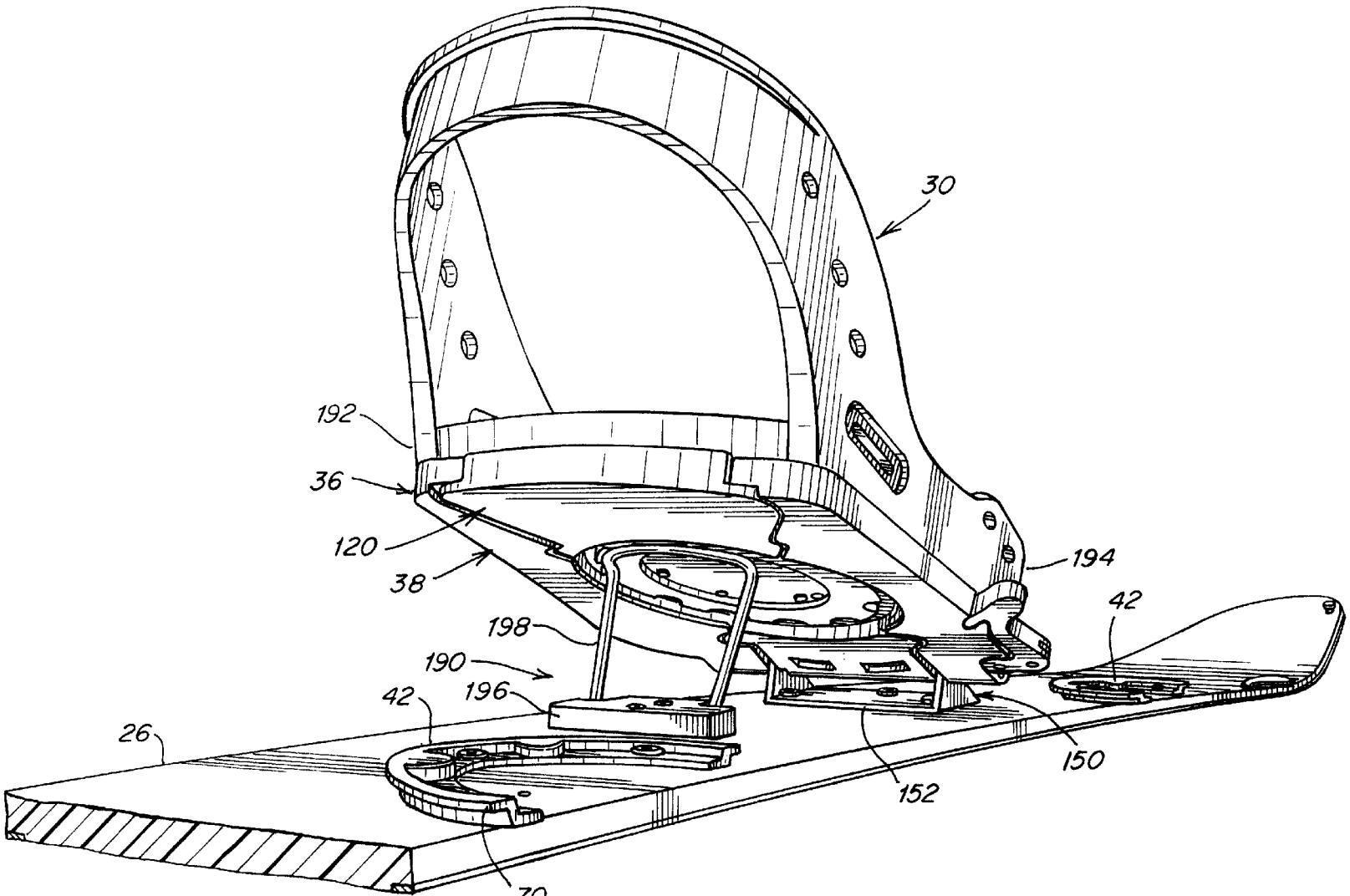
FIG. 9 is a perspective view of a heel lift for raising the binding mechanism of FIGS. 1–8 when in the ascension mode.

In the illustrated embodiment, the heel lift 190 includes a base 196 mountable to the board section and a loop 198, such as a wire loop, rotatably mounted to the base in a manner that allows the loop 198 to be rotated into an upstanding position (see FIG. 9). In this position, the loop 198 may engage the heel end 192. When not in use, the loop 198 may be rotated down toward the board section to lie substantially flat against the board. Of course, the heel lift 190 may be mounted to the interface 36 in a manner such that the base 196 is attached to or is part of the interface 36 and the loop 198 is rotated downward to engage the top surface of the board section.

Although a loop 198 is shown, it is to be appreciated that the present invention is not limited in this respect and that other suitable configurations may be employed for lifting the heel may alternatively be employed. For example, a wedge-shaped element or other suitably shaped element may be attachable to either the board section or to the binding mechanism that raises the heel. Also, it is to be appreciated that the invention is not limited in this respect, as the heel need not be lifted at all.

Although the ascension mode interface 150 and the heel lift 190 are discussed above with respect to a single board section, it is to be appreciated that another ascension mode interface and another heel lift 190 may be attached to the other board half.

Figure 10:
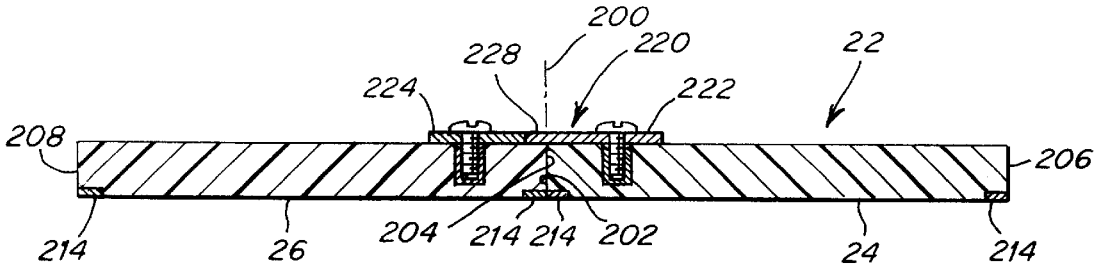
FIG. 10 is a cross-sectional view of a touring snowboard, taken along line 10—10 of FIG. 1, showing a mechanism for reducing relative vertical movement of the board sections according to one embodiment of the invention.

The touring snowboard 22 of the present invention is similar in construction to a conventional snowboard. However, as shown in FIGS. 1 and 10, the snowboard is split down the central longitudinal axis 200 to form two board sections 24, 26. In the embodiment shown, the edges 202, 204 formed on the board sections along the central longitudinal axis are straight edges that run parallel to each other, although other shapes and alignments may be employed. The outer edge 206, 208 of each board section, and thus the snowboard, is formed as a curved edge, as is typical in conventional snowboards. Thus, the waist area 210 of the snowboard is narrower than the width at either the tip area 160 or the tail area 212. Each edge, whether along the outside of the snowboard or on the inside central longitudinal axis, includes a steel edge 214. The steel edges 214 along the outside edges 206, 208 are typical in conventional snowboards, although the present invention is not limited to the use of steel edges. The steel edges 214 on the inside edges 202, 204 are provided for ease of manufacture as well as to provide additional carving when in the ascension mode. Of course, the edge along the central longitudinal axis can alternatively be eliminated.

When the touring snowboard is in the snowboard mode, in order to hold the tip 160 and tail 212 of the board sections generally in the same plane (i.e., preventing vertical movement of one board section relative to the other), a plate 220 or other suitable member may be positioned near each of the tip and tail areas. The plate 220 includes two plate sections 222, 224, one mounted to each board section such that a portion of one plate section extends onto the other board half. This feature is similar to that discussed above with respect to the half-disks. Thus, in one illustrative embodiment, the first board section 24 includes the first plate 222 having a portion 228 that overlies the second board section 26 and the second board section 26 includes the second plate section 224 having a portion 230 that overlies the first board section 24. The plate sections 222, 224 may be fastened to respective board sections with the use of any suitable fastener, such as screws that are secured to threaded inserts formed within the board.

Although the embodiment shown includes at least one plate to limit or prevent relative vertical movement of the board sections, it is to be appreciated that the present invention is not limited in this respect and that no such arrangement need be employed. In addition, rather than provide such an arrangement near both the tip and the tail of the touring snowboard, a single such arrangement may be positioned at either the tip or the tail, or somewhere in-between, as desired. Other suitable arrangements may be employed to limit vertical movement.

Figure 11:
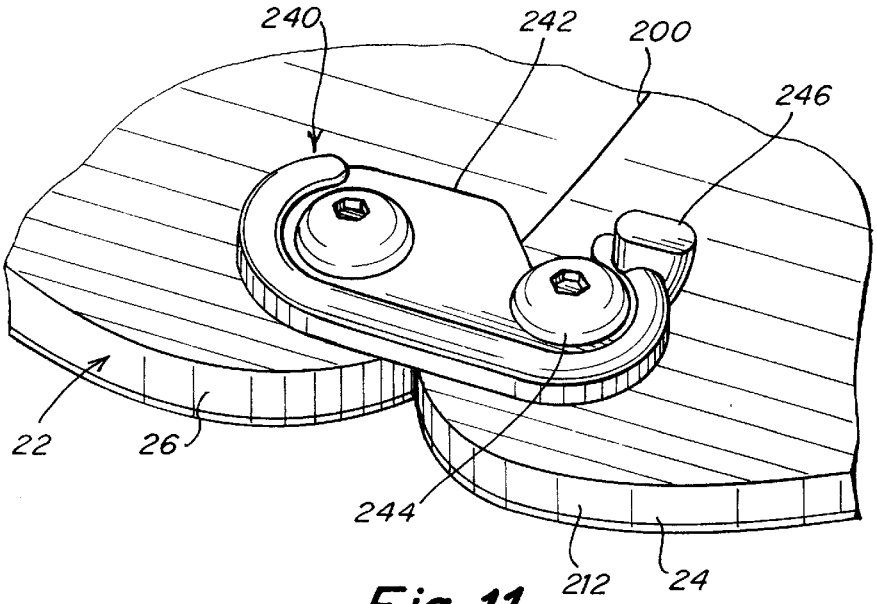
FIG. 11 is an enlarged view of a portion of the touring snowboard encircled at 11 in FIG. 1 showing a latch for securing the touring snowboard in the snowboard mode according to one embodiment of the invention.

To facilitate clamping the two board sections together, as shown in the illustrative embodiments of FIGS. 1 and 11, a latch 240 may be provided at the tip 160, the tail 212, or both the tip 160 and the tail 212 of the touring snowboard 22. Thus, before the clamp 38 is used to secure the two board sections 22, 24 together, a rider may position the board sections adjacent to each other and utilize the latch 240 to hold the two board sections in substantial alignment. The clamp 38 may then readily engage the first interface 34 and may readily be moved into the closed configuration. In the embodiment shown, the latch 240 includes a hook-shaped element 242 rotatably mounted to one board section 26 and a stud 244 that engages the hook-shaped element 242 on the opposite board section. A handle 246 may be formed on the hook-shaped element to facilitate manipulation of the latch 240. Other suitable arrangements for mounting the board sections in substantial alignment may be employed, as the invention is not limited to any particular latch.

The latch 240 may also be employed to limit relative vertical movement between the board sections. Thus, rather than, or in addition to, the plate sections 222, 224, the latch 240 may be formed of a suitable material and structure and may be positioned on the board sections to limit relative vertical movement therebetween.

With the above described binding mechanism 20 and touring snowboard 22, a convenient tool-free conversion between the snowboard mode and the ascension mode may be accomplished. For example, to convert the touring snowboard 22 from the snowboard mode to the ascension mode, a rider merely needs to reach down and release the lever arm 92 so that the clamp 38 moves from the closed configuration to the open configuration. The rider may then lift his or her legs to remove the snowboard boot binding 30, together with the U-shaped member 60 and carrier 120, from the half-disks 40, 42. As can be appreciated, because the lever arm 92 can be manipulated without removing the boot from the snowboard binding 30, the snowboard binding 30 is still attached to the rider's boot. The rider may then unlatch the latches 240 at the tip 160 and tail 212 of the snowboard to allow the board sections 24, 26 to separate.

To complete the conversion, the rider may then take the left board section 24 and place it on the right side and take the right board section 26 and place it on the left side so that the edges 202, 204 along the central longitudinal axis 200 now become the outer edge of the two board sections when in the ascension mode. This may be advantageous because the curve of the outer edges 206, 208 of the snowboard now becomes the inner edges of the board sections so that when the rider is ascending the slope, the bindings are less likely to contact each other. Of course, such switching of the left and right sides need not be performed.

In any event, once the boards are separated, the rider may now position the clamp 38 so that the pivot pins 170, 172 engage the holes 162, 164 in the ascension mode interface 150. The lever arm 92 is then moved so that the clamp 38 moves from the open configuration to the closed configuration whereby the pins 170, 172 engage within the holes 162, 164. The rider may then reach down to flip the heel lift 190 as desired in order to raise the heel end 192 of the interface 36. At this point, the rider is in an ascension mode.

In some instances, it may be desirable to utilize traction elements (also referred to as skins) that attach to the underside of the board sections to facilitate ascending a slope. Such skins are commercially available and comprise a mohair-type fiber extending at an angle from a base fabric or substrate that attaches to the underside of the board sections. Another type of skin comprises a nylon material that attaches to the underside of the board sections. Rather than, or in addition to, using skins, crampons may be attached to the board sections to facilitate ascending a slope.

Once the rider reaches the area from which the rider wishes to descend, the rider may then convert the touring snowboard from the ascension mode back to the snowboard mode. This may be accomplished by reversing the process previously described. For example, the rider actuates the clamp 38 on the left binding mechanism to disengage the left binding mechanism from the left ascension mode interface 150 mounted to the first board section 24. The rider also actuates the clamp 38 on the right binding mechanism to disengage the right binding mechanism from the right ascension mode interface 150 mounted to the second board section 26. The rider may then remove the traction control devices. The rider may then place the board sections together by either directly bringing them in proximity or alternatively, as described above, reversing the left and right board sections such that the left board section now becomes the right board section and the right board section becomes the left board section. The rider may connect the latches 240 at the tip and/or tail in order to temporarily hold the board sections 24, 26 in relative alignment. The clamp 38 is then vertically lowered onto the half-disks 40, 42 and the lever arm 92 is actuated to move the clamp 38 from the open configuration to the closed configuration to readily secure the two board sections 24, 26 together while securing the snowboard boot binding 30 to the snowboard in the snowboard mode.

Advantageously, the binding mechanism of the present invention features tool-free conversion between the snowboard mode and the ascension mode. The binding mechanism is also self-contained in that it utilizes no loose parts that inadvertently may become lost, which can be a significant problem if it occurs in the back country. Further, the clamp of the binding mechanism is accessible without having to remove the snowboard boot from the snowboard boot binding, resulting in quick conversion between modes.

Having thus described certain embodiments of the present invention, various alterations, modification and improvements will readily occur to those skilled in the art. Such alterations, modifications, and improvements are intended to be within the spirit and scope of the invention. Accordingly, the foregoing description is by way of example only, and not intended to be limiting. The invention is limited only as defined in the following claims and the equivalent thereof.

What is claimed is:

1. A binding mechanism for a touring snowboard having at least first and second board sections to be arranged in either of a snowboard mode and an ascension mode, the binding mechanism comprising:

a base configured and arranged to receive a snowboard boot;

a first interface to mount to at least one of the first and second board sections; and a second interface mounted to the base and configured and arranged to engage with the first interface when the touring snowboard is in the snowboard mode to mount the base to the snowboard;

wherein one of the first and second interfaces includes a clamp moveable between a closed configuration wherein the one of the first and second interfaces is adapted to engage with the other of the first and second interfaces and an open configuration wherein the one of the first and second interfaces is adapted to release the other of the first and second interfaces, wherein an amount of clearance exists between the first and second interfaces when the clamp is in the open configuration and wherein the amount of clearance is decreased when the clamp moves from the open configuration to the closed configuration.

2. The binding mechanism according to claim 1, wherein the clamp is adapted to exert clamping forces on one of the first and second interfaces in at least two non-parallel directions to draw the first and second board sections together.

3. The binding mechanism according to claim 1, wherein the binding mechanism is a self-contained binding mechanism that comprises no loose components used in transitioning between the snowboard mode and the ascension mode.

4. The binding mechanism according to claim 1, wherein the first interface includes a first interface portion mountable to the first board section and a second interface portion mountable to the second board section.

5. The binding mechanism according to claim 4, wherein the clamp is coupled to the second interface and wherein the clamp includes a U-shaped member having a base portion and first and second arms joined to opposite sides of the base portion, the first and second arms each engaging the first and second interface portions of the first interface.

6. The binding mechanism according to claim 5, wherein the clamp includes a lock operably coupled to the first and second arms of the U-shaped member to draw the first and second arms toward each other to move the clamp to the closed configuration and to push the first and second arms away from each other to move the clamp to the open configuration, the lock comprising a link coupled to the first arm and a lever arm coupled to the link and to the second arm.

7. The binding mechanism according to claim 6, wherein the lever arm is constructed and arranged to engage the second arm when the clamp is in the closed configuration.

8. The binding mechanism according to claim 6, wherein the link extends along an arc.

9. The binding mechanism according to claim 8, wherein the lock is an over-center lock.

10. The binding mechanism according to claim 1, wherein the clamp includes a lock operable to move the clamp between the open configuration and the closed configuration.

11. The binding mechanism according to claim 10, wherein the lock is an over-center lock.

12. The binding mechanism according to claim 5, wherein the first and second interface portions of the first interface each includes a lobe and wherein the first and second arms each includes a mating shelf, the lobes being constructed and arranged to engage the shelves such that when the clamp is in the closed configuration, lifting forces imparted to the binding mechanism are resisted.

13. The binding mechanism according to claim 1, wherein the clamp is biased toward the open configuration.

14. The binding mechanism according to claim 4, wherein a section of the first interface portion is constructed and arranged to overlie the second board section when mounted thereto and wherein a section of the second interface portion is constructed and arranged to overlie the first board section when mounted thereto.

15. The binding mechanism according to claim 4, wherein at least one of the first and second interface portions includes an indexing feature that cooperates with the second interface, the indexing feature adapted to align the second interface in a desired angular position relative to the snowboard.

16. The binding mechanism according to claim 15, wherein the second interface comprises a carrier disk constructed and arranged to mount to the base, the carrier disk including a mating indexing feature that cooperates with the indexing feature on the at least one of the first and second portions of the first interface.

17. The binding mechanism according to claim 4, wherein at least one of the first and second interface portions includes an anti-rotation feature that cooperates with the second interface to prevent rotation of the first interface relative to the second interface.

18. The binding mechanism according to claim 17, wherein the second interface comprises a carrier disk constructed and arranged to mount to the base, the carrier disk including a mating anti-rotation feature that cooperates with the anti-rotation feature on the at least one of the first and second interface portions.

19. The binding mechanism according to claim 4, wherein the first and second interface portions are each crescent shaped.

20. The binding mechanism according to claim 1, wherein the clamp is adapted to exert clamping forces on one of the first and second interfaces, the clamping force being adjustably selectable by the rider.

21. The binding mechanism according to claim 1, wherein the second interface provides a substantially gap-free support for mounting the base to the board sections to increase board response and rider sensitivity.

22. The binding mechanism according to claim 1, in combination with the touring snowboard.

23. The combination according to claim 22, wherein the first interface includes a first interface portion mounted to the first board section and a second interface portion mounted to the second board section.

24. The combination according to claim 23, wherein a section of the first interface portion is constructed and arranged to overlie the second board section and wherein a section of the second interface portion is constructed and arranged to overlie the first board section.

25. The combination according to claim 23, wherein the first and second interface portions are mountable to the board sections in one of a plurality of longitudinal positions to allow adjustment of the stance width of the snowboard binding.

26. The combination according to claim 25, wherein the stance angle of the snowboard binding may be adjusted independently of the stance width.

27. The combination according to claim 23, wherein the first and second interface portions are each crescent shaped.

28. The combination according to claim 23, wherein the first board section includes at least two mounting holes to receive the first interface portion and wherein the second board section includes at least two mounting holes to receive the second interface portion, the mounting holes lying on a circle when the two board sections are joined together.

29. A binding mechanism for a touring snowboard having at least first and second board sections to be arranged in either of a snowboard mode and an ascension mode, the binding mechanism comprising:

a base configured and arranged to receive a snowboard boot;

at least one snowboard mode interface to mount the base to the snowboard in the snowboard mode;

at least one ascension mode interface to mount the base to one of the first and second board sections in the ascension mode; and a clamp, coupled to the base, moveable between an open configuration and a closed configuration, wherein in the closed configuration the clamp is adapted to clamp onto the at least one snowboard mode interface when in the snowboard mode, wherein in the closed configuration an engagement feature operatively associated with the clamp is adapted to engage with the at least one ascension mode interface when in the ascension mode, and wherein in the open configuration the clamp is adapted to release the at least one snowboard mode interface in the snowboard mode and to disengage the engagement feature from engagement with the at least one ascension mode interface in the ascension mode.

30. The binding mechanism according to claim 29, wherein the snowboard mode interface includes a first portion mountable to the first board section and a second portion mountable to the second board section.

31. The binding mechanism according to claim 29, wherein one of the clamp and the ascension mode interface includes at least one pin and wherein the other one of the clamp and the ascension mode interface includes a mating receptacle that receives the pin to secure the clamp to the ascension mode interface.

32. The binding mechanism according to claim 31, wherein the clamp is pivotally engageable with the ascension mode interface about the pivot pin.

33. The binding mechanism according to claim 32, wherein a longitudinal axis of the base may extend in a direction that is not perpendicular to a pivot axis defined by the pivot pin when the clamp is engaged with the ascension mode interface.

34. The binding mechanism according to claim 29, wherein the binding mechanism is a self-contained binding mechanism that comprises no loose components used in transitioning between the snowboard mode and the ascension mode.

35. The binding mechanism according to claim 29, wherein the clamp includes a lock operable to move the clamp between the open configuration and the closed configuration.

36. The binding mechanism according to claim 35, wherein the lock is an over-center lock.

37. The binding mechanism according to claim 29, in combination with the touring snowboard.

38. The combination according to claim 37, wherein the snowboard mode interface includes a first half-disk mounted to the first board section and a second half-disk mounted to the second board section.

39. The combination according to claim 37, wherein one ascension mode interface is mounted to the first board section and another ascension mode interface is mounted to the second board section, each ascension mode interface being constructed and arranged to engage respective clamps when the touring snowboard is in the ascension mode.

40. A binding mechanism for a touring snowboard having at least first and second board sections to be arranged in either of a snowboard mode and an ascension mode, the binding mechanism comprising:

a base configured and arranged to receive a snowboard boot;

a first interface to mount to at least one of the first and second board sections;

a second interface mounted to the base and configured and arranged to engage with the first interface when the touring snowboard is in the snowboard mode to mount the base to the snowboard; and means, operatively coupled between the first and second interfaces, for decreasing an amount of clearance between the first and second interfaces to clamp the first interface to the second interface when in the snowboard mode;

wherein the first interface includes a first interface portion mountable to the first board section and a second interface portion mountable to the second board section.

41. The binding mechanism according to claim 40, wherein the means for decreasing the amount of clearance between the first and second interfaces includes a clamp coupled to the second interface and wherein the clamp includes a U-shaped member having a base portion and first and second arms joined to opposite sides of the base portion, the first and second arms each engaging the first and second interface portions.

42. The binding mechanism according to claim 41, wherein the clamp includes a lock operably coupled to the first and second arms of the U-shaped member to draw the first and second arms toward each other to move the clamp to the closed configuration and to push the first and second arms away from each other to move the clamp to the open configuration, the lock comprising a link coupled to the first arm and a lever arm coupled to the link and to the second arm.

43. The binding mechanism according to claim 41, wherein the clamp is biased toward the open configuration.

44. The binding mechanism according to claim 40, wherein the first and second interface portions comprises first and second crescent shaped half-disks.

45. The binding mechanism according to claim 40, further comprising means, operatively coupled between the first and second interface portions, for exerting clamping forces on the first and second interface portions in at least two non-parallel directions to draw the first and second board sections together.

* * * * *